United States Patent [19]

Beneke

[11] 4,045,091

[45] Aug. 30, 1977

[54] DEVICE FOR THE PNEUMATIC FEEDING OF A QUANTITY OF CARDS

[76] Inventor: Wolfgang Beneke, 4072 Wickrathberg, Gudderather Weg 28, Germany

[21] Appl. No.: 667,383

[22] Filed: Mar. 16, 1976

Related U.S. Application Data

[63] Continuation of Ser. No. 591,692, June 30, 1975, abandoned, which is a continuation of Ser. No. 391,766, Aug. 27, 1973, abandoned.

[30] Foreign Application Priority Data

Aug. 26, 1972 Germany ..... 2242038

[51] Int. Cl.[2] ..... B65G 53/60

[52] U.S. Cl. ..... 302/28; 19/105

[58] Field of Search ..... 302/27, 28, 3, 39; 19/105

[56] References Cited

U.S. PATENT DOCUMENTS

| | | | |
|---|---|---|---|
| 412,985 | 10/1889 | Schnitzler | 302/28 |
| 1,468,966 | 9/1923 | Herington | 302/28 |
| 2,918,330 | 12/1959 | Pfening | 302/28 |
| 2,989,348 | 6/1961 | Reed | 302/28 |
| 3,077,365 | 2/1963 | Fisher | 302/28 |
| 3,311,418 | 3/1967 | Scruby et al. | 302/3 |
| 3,414,330 | 12/1968 | Trutzschler | 302/28 |

*Primary Examiner*—Evon C. Blunk
*Assistant Examiner*—Jeffrey V. Nase
*Attorney, Agent, or Firm*—Holman & Stern

[57] ABSTRACT

A device for the pneumatic feeding of a quantity of cards by means of deposit chutes lined up to the individual cards which are connected one after the other to a common pneumatic feed line, which ends at the last chute, is disclosed. The device comprises of each of the deposit chutes being connected to several pneumatic feed lines and selecting means being disposed at the head of each of the deposit chutes for selecting which of the pneumatic feed lines are to be connected to the deposit chutes.

1 Claim, 4 Drawing Figures

DEVICE FOR THE PNEUMATIC FEEDING OF A QUANTITY OF CARDS

This is a continuation of application Ser. No. 591,692 filed June 30, 1975, now abandoned, which in turn is a Rule 60 Continuation application of Ser. No. 391,766 filed Aug. 27, 1973, now abandoned.

BACKGROUND OF THE INVENTION

This invention relates to a device for the pneumatic feeding of a quantity of cards by means of deposit chutes lined up to the individual cards which are connected one after the other to a common pneumatic feed line.

Known devices of the prior art have the disadvantage that all cards connected to the feed line have to work on the same sort of material. However, it is also known in the art that by using a process in which the material which is to be worked is presented to the cards in the form of skeins, it is possible to vary the sort of material for the individual cards. On the other hand, devices of the present invention have considerable advantages over the process which feeds the cards with skeins.

SUMMARY OF THE INVENTION

The general object of this invention is to provide a new and improved device for the pneumatic feeding of a quantity of cards.

Another object of the invention is to create a device of the aforementioned type using pneumatic feeding which allows the material presented to the cards to be more easily varied.

In the achievement of the above and other objects of the present invention there are provided deposit chutes, each of which is connected to several pneumatic feeding lines, and at the head of each chute there is a device which permits the capability of selecting which of the lines are to be connected with the chute. It is also expedient that in this invention the pneumatic supply takes place in two opposite directions.

This invention is also suitable for devices in which, after the last chute, excess material is carried back, as well as for devices in which the line ends at the head of the last chute served by it. In the latter case, it is advisable that the head of every chute which is the last to be served by a line should be made as an end-head, which is already known.

BRIEF DESCRIPTION OF THE DRAWINGS

These and other objects of the invention will be readily understood when the detailed description is taken in conjunction with the drawings, wherein.

DETAILED DESCRIPTION OF THE PREFERRED EMBODIMENT

Figure 1:
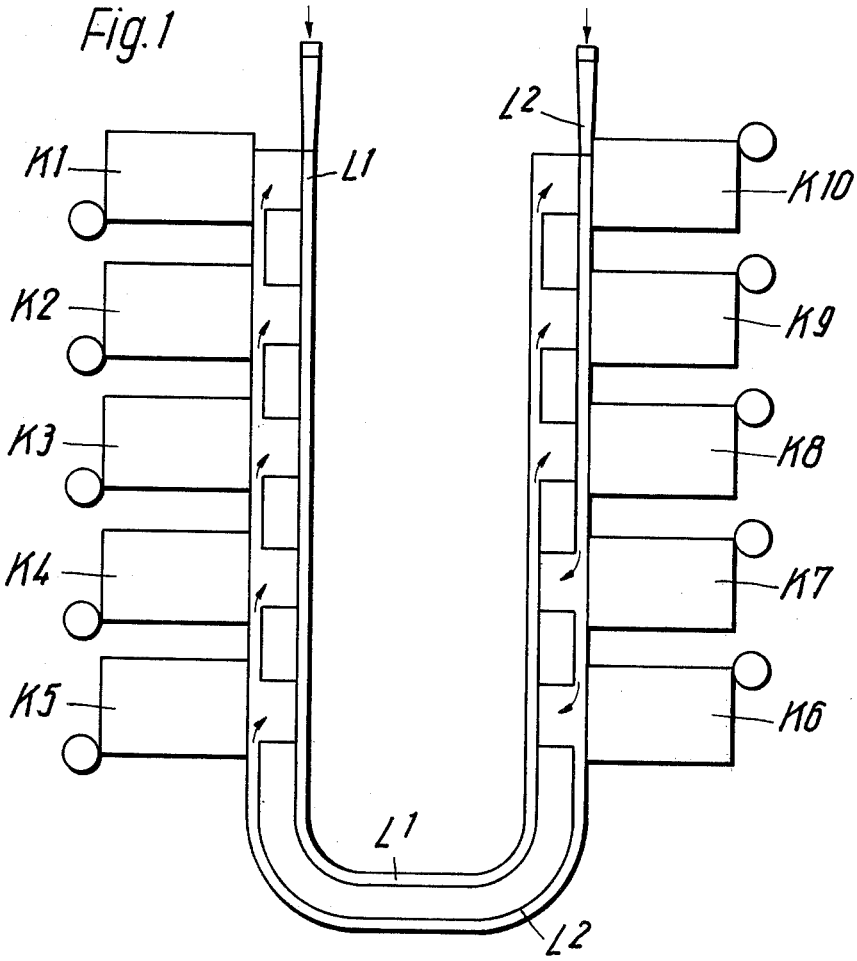
FIG. 1 shows a top view of the device, according to the invention.
Figure 2:
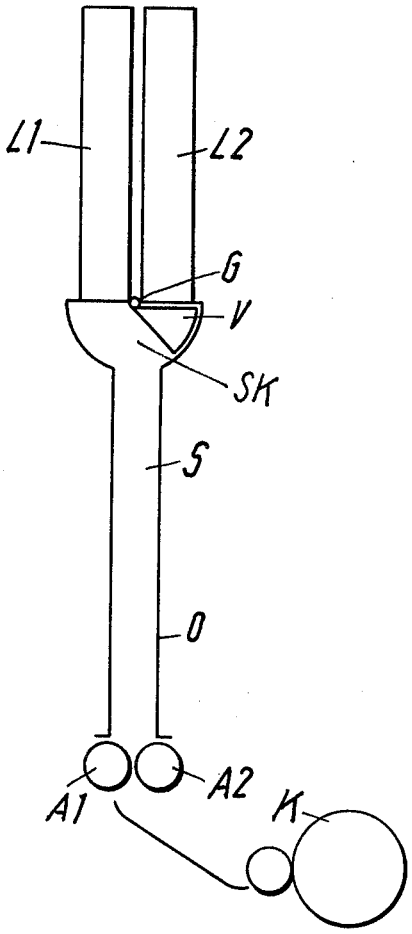
FIG. 2 shows a longitudinal section through the deposit chute and feed lines connected to it in the manner shown in FIG. 1.

FIG. 1 shows ten cards K1 to K10 and two parallel lines L1 and L2. Each card K1 to K10 is lined up to a deposit chute. FIG. 2 shows such a deposit chute S, which has a widened chute head SK into which the lines L1 and L2 lead. Air vents O through which the supply air passes are provided in a side wall of the chute. At the bottom end of the chute S, there is a pair of rollers A1 and A2 through which the fiber flocks pass from the deposit chute to the card K in the form of a ribbon of wadding.

In the head SK of the chute S (FIG. 2), there is a hinged cover V, which can be moved pivotally about the joint G, so that it closes either line L1 or L2. In this way each of the deposit chutes of cards K1 to K10 can be connected as desired either with line L1 or with line L2, and every card can be supplied with material brought either through line L1 or through line L2.

Lines L1 and L2 run in opposite directions, i.e. line L1 serves card K1 first and then card K2 and so on, whereas line L2 serves card K10 first, then card K9 and so on. In FIG. 1 arrows indicate which cards are served by which lines. In this line L1 serves cards K8, K9 and K10, and the rest of the cards are served by line L2. The head of the deposit chute of card K1 and the head of the deposit chute of card K10 are made as end-heads.

Figure 4:
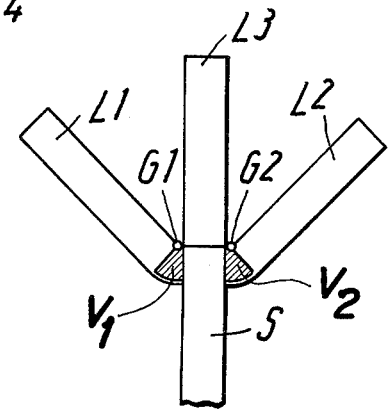
FIG. 4 shows a longitudinal section through the upper part of the chute and the feed lines which can be connected to it of the device in the manner shown in FIG. 3.
Figure 3:
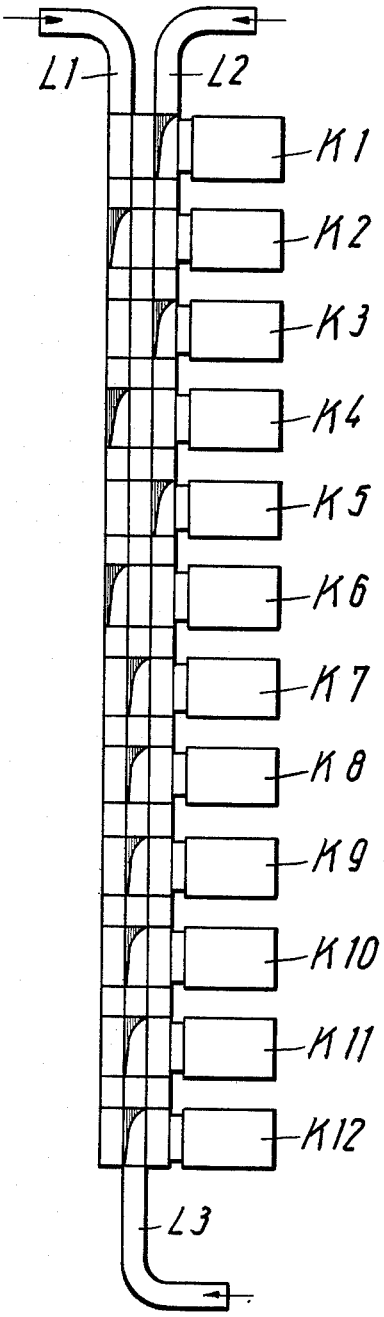
FIG. 3 shows a top view of another embodiment of the device according to the invention.

In the device shown in FIG. 3, three feed lines L1, L2 and L3 are connected to twelve cards K1 to K12. Cards K1, K3 and K5 are connected to line L2, cards K2, K4 and K6 being connected to line L1 and the rest of the cards being connected to line L3. FIG. 4 shows that at the head of chute S there are two hinged covers V1 and V2 which can be moved pivotally about the joints G1 and G2, so that it is possible to select which of the lines L1, L2 and L3 are to be closed while the third one will be open to the chute. ACCORDINGLY,

What is claimed is:

1. A device for pneumatic feeding of fiber flocks to a series of cards, each of said cards being fed by means of a deposit chute, at least two pneumatic lines having ends for feeding fiber flock selectively communicating with said deposit chutes, means disposed at the inlet of each of said deposit chutes to selectively connect or disconnect each said deposit chute to one of said pneumatic lines without interfering with flock flow through said lines to other deposit chutes whereby flock passing through any of said pneumatic lines may be simultaneously fed to one or more of said cards said means disposed at the inlet of each deposit chute consists of a flap pivotally movable to permit flock flow from one of said lines into said chute and to block flow from the other of said lines into said same chute.

* * * * *